United States Patent [19]

Moore et al.

[11] Patent Number: 4,523,686

[45] Date of Patent: Jun. 18, 1985

[54] ANTI-TWO BLOCK SYSTEM

[75] Inventors: Donald E. Moore, Marion; David W. Olsen, Palo, both of Iowa

[73] Assignee: FMC Corporation, Chicago, Ill.

[21] Appl. No.: 647,851

[22] Filed: Aug. 31, 1984

Related U.S. Application Data

[63] Continuation of Ser. No. 402,517, Jul. 28, 1982, abandoned.

[51] Int. Cl.[3] ..... B66C 13/48

[52] U.S. Cl. ..... 212/152; 212/163; 60/444

[58] Field of Search ..... 212/149, 150, 151, 152, 212/162, 163, 239, 262, 164; 254/269; 60/444

[56] References Cited

U.S. PATENT DOCUMENTS

| | | | |
|---|---|---|---|
| 2,328,697 | 9/1943 | White | 212/152 |
| 3,814,265 | 6/1974 | Miller | 212/149 |
| 3,854,128 | 12/1974 | Yamagishi . | |
| 3,943,716 | 3/1976 | Andersson | 60/444 |
| 3,999,387 | 12/1976 | Knopf | 60/465 |
| 4,003,482 | 1/1977 | Cheze . | |
| 4,052,602 | 10/1977 | Horn et al. . | |
| 4,136,855 | 1/1979 | Morrow, Sr. et al. | 60/483 |
| 4,165,613 | 8/1979 | Bernhoft et al. | 60/420 |
| 4,219,121 | 8/1980 | McPeak . | |
| 4,300,134 | 11/1981 | Paciorek . | |
| 4,395,706 | 7/1983 | Garber . | |

FOREIGN PATENT DOCUMENTS

| | | | |
|---|---|---|---|
| 2027854 | 2/1980 | United Kingdom | 60/444 |

*Primary Examiner*—Trygve M. Blix
*Assistant Examiner*—Thomas J. Brahan
*Attorney, Agent, or Firm*—R. C. Kamp; Richard B. Megley

[57] ABSTRACT

An improved anti-two block system having a boom hoist drum driven by a first hydraulic motor with a first variable displacement motor controlled by a first ram moveable in a given direction to supply fluid pressure for driving the boom drum to lower a boom and a hook block drum driven by a second hydraulic motor with a second variable displacement pump controlled by second ram moveable in a given direction to supply fluid pressure for driving the hook drum to raise a hook block. A differential mechanism sums the movement of the hook block and boom and activates a switch to energize solenoid valve means, when the hook block is a predetermined distance from the boom, to preclude movement of said rams in the given directions.

1 Claim, 3 Drawing Figures

ANTI-TWO BLOCK SYSTEM

This application is a continuation, of U.S. application Ser. No. 402,517, filed 07/28/82, now abandoned.

BACKGROUND AND SUMMARY OF THE INVENTION

In the field of cranes, i.e. machines that lift loads suspended from a hook block attached to a wire rope trained over a sheave on the tip section of a lufting boom and wound on the drum of a winch, contact between the hook block and the tip section of the crane's boom is undesirable because of the possibility of damage to the crane as a consequence. Reeling in the wire rope on the drum will, of course, cause the hook block to approach the boom tip. So also will lowering tne boom, i.e. increasing the angle between the boom and a vertical line through the boom foot pivot axis, because of the geometry involved. The center of the arc traced by a point on the boom tip is the boom foot pivot axis, but the comparable center for the wire rope where it contacts the sheave on the boom tip is the rope's point of contact with either that drum or sheave which is fixed relative to the crane's upper structure. These two centers cause their respective arcs to diverge as the boom is lowered; the amount of such divergence increasing as the distance between the two centers increase. This divergence is compensated for by the hook block moving toward and away from the boom tip as the boom is respectively lowered and raised.

To prevent contact between the hook block and the tip section, automatic limiting devices, which are commonly called anti-two block devices, have been utilized in the prior art. These devices preclude lowering of the boom and/or further reeling in of the hoist line when the hook block attached thereto is a pre-determined distance from the tip section. Such prior art devices have utilized a mechanism suspended from the boom tip which trips a limit switch, when the hook block contacts that mechanism, to break an electrical circuit and thereby deactivate solenoids which must be activated for operation of the hook block hoist raise and boom hoist lower controls. Such arrangements are undesirable because the switch and the associated tripping mechanism are exposed to the ravages of the elements, are difficult to install and service due to the boom tip location of these components, especially on a tower crane where the boom cannot be readily lowered to the ground, and are subjected to possible damage during erection or disassembly of the crane and during operation of the crane by hoisting the hook block at high speed into the tripping mechanism. In addition, raising the hook block while simultaneously swinging the crane often causes the tripping mechanism to contact the hoist line thereby creating a tendancy for the tripping mechanism itself to "climb" the wire rope and strike the boom tip, resulting in the possibility of damage to the crane. Finally, placement of any weight on the boom not absolutely necessary for the actual support and lifting of a load, especially weight concentrated at the tip section, diminishes the lifting capacity of the crane.

The present invention provides an anti-two block system which automatically precludes contact between the hook block and boom tip section and which is devoid of the aforementioned problems, disadvantages and limitations of the prior art anti-two block devices.

DETAILED DESCRIPTION

Figure 1:
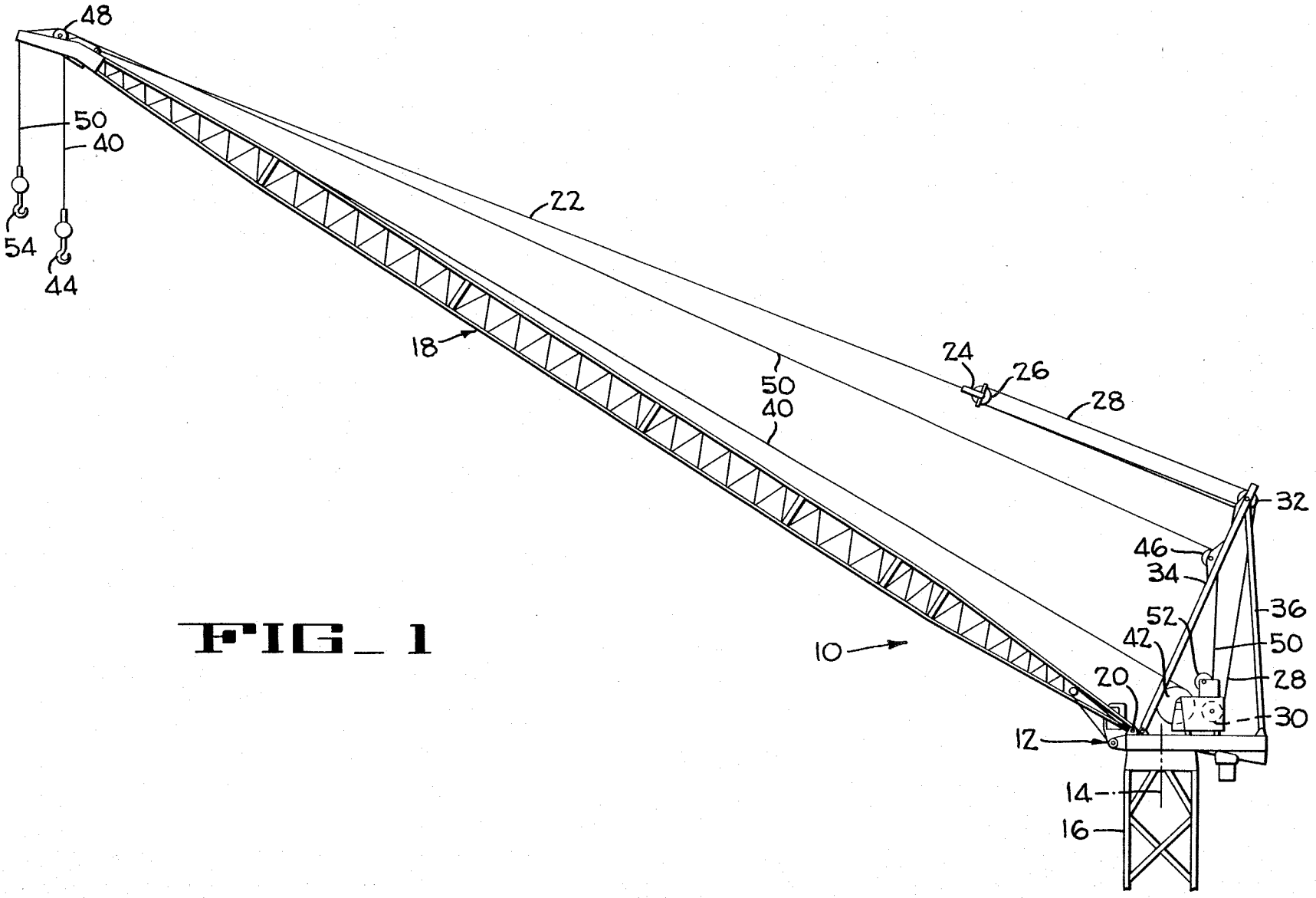
FIG. 1 is a side elevation of a tower crane embodying the present invention.

Referring to FIG. 1, a tower crane indicated generally at 10, includes an upper works 12 mounted for rotation about vertical axis 14 on a tower 16. While a tower crane has been utilized herein for purposes of illustration, it is to be understood that the present invention would be applicable to other types of cranes as well. A boom 18 is pivotally mounted at 20 on the upper works 12. Pendants 22 is secured between the tip of the boom 18 and a bridle 24 which carrys a sheave set 26. A wire rope 28 extends from the drum 30 of a power winch carried on the upper works 12 and is reaved between a sheave set 32 mounted on a mast 34 and the sheave set 26. The mast 34 has its lower ends secured to the upper works 12 and is made rigid by backstay 36 secured between the upper end of mast 34 and the upper works 12. The sheave set 32 is therefore rendered stationary, though each sheave thereon is free to independently rotate. Rotation of the drum 30 clockwise, as viewed in FIG. 1, will cause the rope 28 to be reeled in and the bridle 24 to approach stationary sheave set 32 in proportion to the parts of line or rope extending between the two sheave sets 26 and 32. This will cause the boom 18 to pivot about the pin 20, decreasing the angle of the boom from vertical and resulting in a shorter radius. Similarly, rotation of the drum 30 counterclockwise will cause the boom radius to increase. As rope is payed out from the drum 30, the bridle 24 is permitted to move away from the stationary sheave set 32, thus causing the angle of the boom from vertical to increase and thereby providing a longer radius.

A main hoist line 40 extends from main hoist drum 42 and over a sheave mounted on the tip of the boom 18. A hook block 44 is attached to the free end of the line 40. Clockwise rotation of drum 42 will cause the line 40 to be reeled in and the hook block 44 to approach the tip of boom 18. Counterclockwise rotation of drum 42 will permit the hook block 44 to move away from the tip section of boom 18. An auxiliary hoist line 50 is wound on the auxiliary hoist drum 52, extends over a sheave 46 rotatably mounted on the mast 34, and over appropriate sheaves, one of which is shown at 48, to support a hook block 54. Similar to drum 42, clockwise and counterclockwise rotation of the drum 52 will cause the hook block 54 to move toward and away from the tip of the boom 18 respectively. Since both of the drums 42 and the sheave 48 are remote from the boom foot pivot at 20, lowering of the boom 18, i.e. booming out or increasing the radius, will cause each of the hook blocks 44 and 54 to move toward the boom tip. However, since the sheave 46 is considerably farther from the boom foot pivot pin 20 than the drum 42 is, there will be significantly more movement of the hook block 54 vis-a-vis hook block 44, toward the boom 18 on lowering thereof. The present invention therefore will have more significant application to the auxiliary hoist control than to the main hoist control. The following description will be directed to the former, although the invention herein would be equally applicable to either or both.

Figure 2:
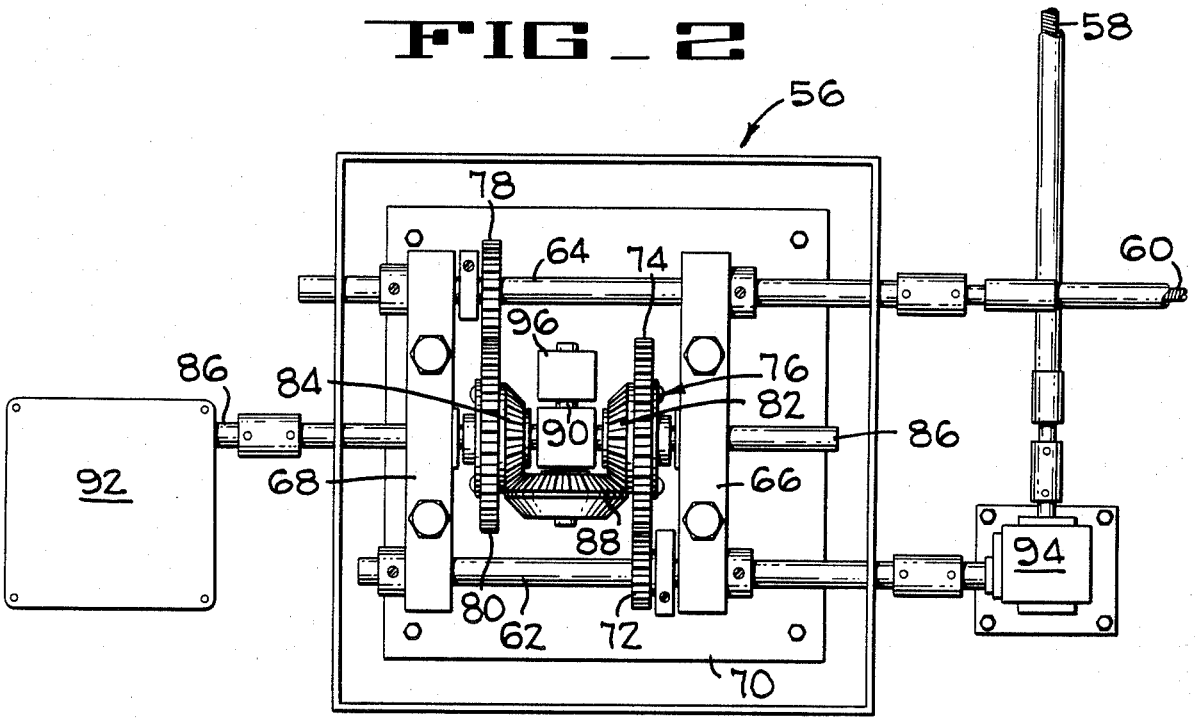
FIG. 2 is a top plan view of a preferred embodiment of the present invention.

A mechanical summation device, indicated generally at 56 in FIG. 2, has two inputs, one thru flexible drive cable 58 and the other thru flexible drive cable 60. The drive cable 58 is connected to rotate in response to rotation of the boom hoist drum 30, such as by means of the small pilot gear affixed to cable 58 and meshing with the winch drive gear affixed to the drum 30. The drive cable 60 is similarly connected to rotate in response to rotation of the auxiliary hoist drum 52, such as by a small pilot gear affixed to cable 60 and meshing with the winch drive gear attached to the drum 52. Two cables 58 and 60 are respectfully connected to drive shafts 62 and 64 which are rotatably supported by bearing blocks 66 and 68 mounted on a housing 70. Secured to the shaft 62 is an input drive gear 72, which meshes with an end gear 74 of a differential assembly 76. A similar input drive gear 78 affixed to shaft 64 meshes with the other end gear 80 of the assembly 76. Bevel gears 82 and 84 are secured to end gears 74 and 80 respectively and each combination gear set is bearing mounted on the spider shaft 86, which shaft is rotatably supported in bearing blocks 66 and 68. A spider gear 88 is bearing mounted for relative rotation on spider cross arm 90. The cross arm 90 is rigidly secured to the spider shaft 86, which latter shaft constitutes the output of the summation device 56 and connects directly to a rotary limit switch 92. When one of the input gears 72 and 80 is held stationary while the other is rotated, the spider bevel gear 88 is forced to rotate on the cross shaft and therefore to run around the stationary one of the end bevel gears. This causes the cross arm 90 to rotate the spider shaft 86, which rotation is transmitted directly to the rotary limit switch 92. When both input drive gears 72 and 78 are rotated, the direction and degree or rotation of the shaft 86 is a summation of the two input rotations. This summation may be expressed by the following: $W_A+W_B=2W_{Arm}$, where $W_A$ and $W_B$ are the two input rotations and $W_{Arm}$ is the output rotation.

It is convenient to use a miter gear differential with all three bevel gears of equal size, providing a 1:1 ratio between the spider gear 88 and end bevel gear 82 and 84. Since the auxiliary hoist drum 52 is usually of smaller diameter then the boom hoist drum 42, a gear reduction is provided, such as right angle drive gear reducer 94 interposed between the drive cable 58 and shaft 62, to compensate for the greater rotation required of the auxiliary drum to reel in or payout a given amount of line vis-a-vis the boom hoist drum. The overall gear reductions for the two inputs to the summation device 56 are sized so that the input shaft 86 to the limit switch 92 will rotate through the same number of turns when the auxiliary hook block 54 is raised a given distance, in relation to the boom tip, as when the boom 18 is moved down through an angle that caused the hook block to raise the same distance. When this relationship exists, simultaneous raising of the boom and lowering of the hook block at the same speed will result in the limit switch input remaining stationery, i.e. no net rotation of shaft 86. Under these conditions, $W_{Arm}$ is equal to zero and the previous equation reduces to $W_A=-W_B$, which equation may be conveniently utilized to size the components in the system. Since the power being transmitted thru the differential assembly 76 is relatively small, essentially that power needed to actuate the limit switch, only a single spider gear 88 is necessary and the imbalance created by the absence of a gear opposite gear 88 compensated for by the addition of a balancing block 96 affixed to the shaft 90 on the opposite side of shaft 86.

Figure 3:
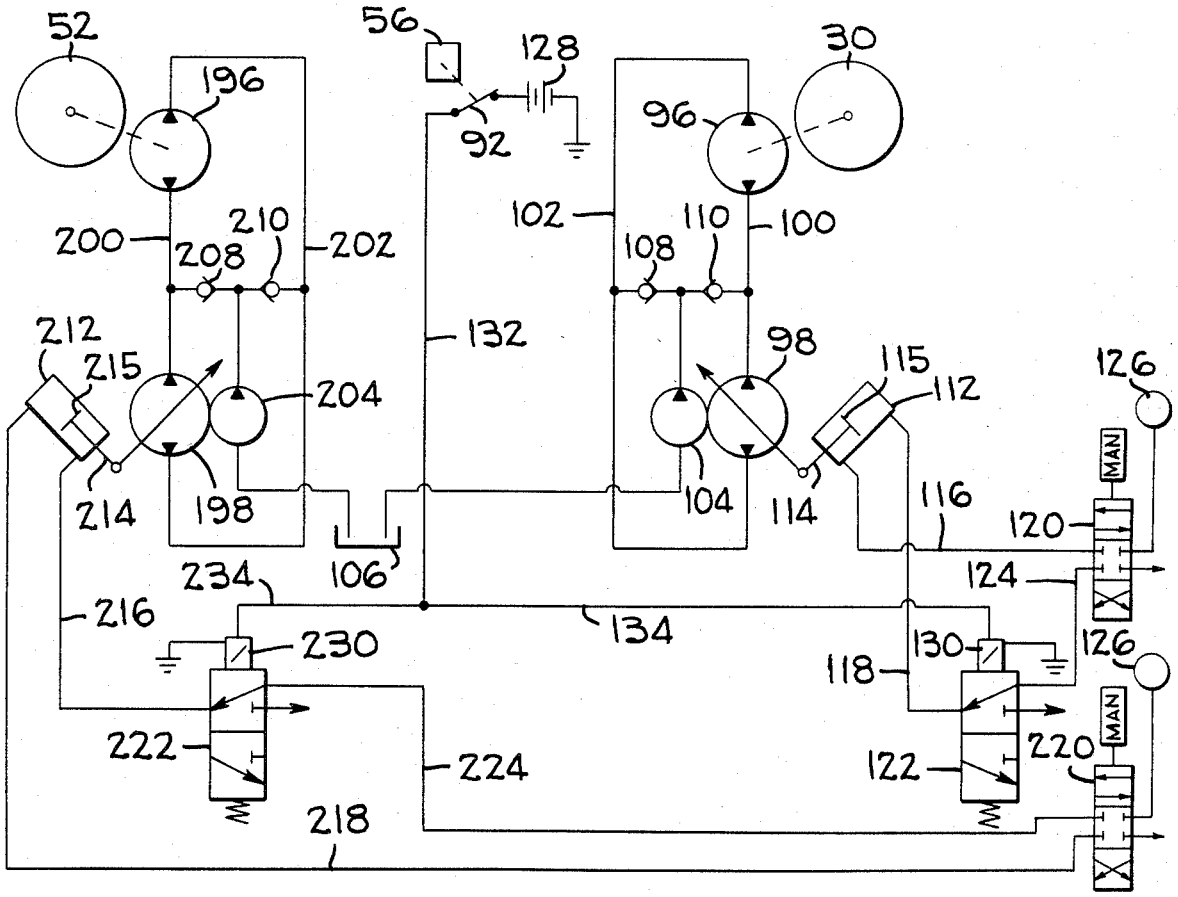
FIG. 3 is a hydraulic, pneumatic and electrical schematic of a circuit employed with the preferred embodiment of FIG. 2.

Referring now to FIG. 3, the drum 30 is driven by a reversible hydraulic motor 96 in a conventional manner. A variable displacement pump 98 having a swash plate tiltable in either direction from a central neutral position, is connected with the motor 96 through conduits 100 and 102; one of these conduits delivering hydraulic fluid under pressure to the motor 96, and thereby determining the direction of rotation of the motor 96 and drum 30, and the other conduit connecting the discharge of the motor 96 with the suction side of the pump 98. A charge pump 104 supplies make-up fluid from a reservoir 106, precluding cavitation of the pump 98; the check valves 108 and 110 serving to direct the output of the charge pump 104 only to the particular one of the conduits 100 and 102 connected with the suction side of the pump 98. The arrangement of pump 98 and motor 96 form a conventional hydrostatic transmission. A pneumatic ram 112 has its piston rod 114 connected to control the direction and degree of tilt for the swash plate of pump 98. Extension of the rod 114 will cause the pump 98 to be displaced so that pressure is supplied to rotate the motor 96 and boom hoist drum 30 in a counter-clockwise direction to lower the boom 18. Retraction of the rod 114 will displace the pump 98 in the opposite direction so that the motor 96 and drum 30 will rotate in a clockwise direction to raise the boom 18. Positioning of the rod 114 is dependent upon the position of the attached piston 115, which position is determined by air pressure directed to the rod end of ram 112 through air line 116 and to the head end through air line 118. The air line 116 connects with a conventional manual control valve 120 located in the operator's cab. The air line 118 connects with a solenoid valve 122 and air line 124 connects between valve 122 and valve 120. The valve 122 is normally spring biased to the position shown in FIG. 3 in which free communication is established between lines 118 and 124. Shifting manual control valve 120 downward, as viewed in the drawing, will direct air pressure from the air tank 126 to the rod end of ram 112 through line 116. Simultaneously the line 124 will be exhausted to atmosphere through valve 120 and, since lines 124 and 118 are in communication, the head end of ram 112 will also be exhausted permitting the rod 114 to be retracted. Similarly, movement of the valve 120 upward will exhaust line 116 while directing air pressure from the tank 126 through conduits 124 and 118 to the head end of ram 112, thereby causing the rod 114 to be extended. However, when the switch 92 is closed, the circuit between the battery 128 and the coil 130 of the solenoid valve 122 is completed through conductors 132 and 134 to ground and the solenoid valve is energized causing the valve 122 to shift upward. In its upward position, the line 124 is blocked and the line 118 is exhausted to atmosphere. In this condition, the line 118 can not be pressurized, even though the valve 120 is shifted upward connecting the tank 126 with line 124. Hence, extension of the rod 114 to cause the drum 30 to rotate in a direction to lower the boom is precluded. Two-blocking is, therefore, prevented. It is however, possible to retract the rod 114 in order to raise the boom, even with the switch 92 closed, because the line 116 connects directly between the rod end of ram 112 and the manual valve 120, while the line 118 is connected with atmosphere through valve 122.

A similar arrangement prevents the hoist drum 52 from reeling in cable to raise the hook block when the possibility of two-blocking is present. The hoist drum 52 is driven by a hydraulic motor 196 hydraulically connected with a variable displacement pump 198 through conduits 200 and 202. A charge pump 204 draws fluid from the reservoir 106 and discharges its output between two check valves 208 and 210, which valves assure discharge thereof into the low pressure one of conduits 200 and 202. A pneumatic ram 212 having a piston rod 214 affixed to a piston 215 is connected to control the direction and degree of tilt of the swash plate of pump 198. Extension of the rod 214 will cause the drum to pay-off cable and lower the hook block 44, and retraction of the rod 214 will cause the drum 52 to reel in cable, raising the hook block relative to the boom. Air pressure selectively metered to or exhausted from the head and rod ends of the ram 212 will determine the extension or retraction of the rod 214. An air line 216 connects between the rod end of ram 212 and a solenoid valve 222 with air line 224 connecting between the latter and manual control valve 220. An air line 218 connects directly between the head end of ram 212 and valve 230. With the valve 220 in its deenergized condition, as shown in FIG. 3, the air lines 216 and 224 are in communication. Movement of the valve 220 upward directs air pressure from the tank 126 to the head end of ram 212 while exhausting the rod end to atmosphere, causing the drum 52 to rotate in a direction to lower the hook block 44. Downward movement of the valve 220 will connect the air tank 126 with the rod end of ram 212 through air lines 224 and 216 causing the drum 52 to rotate in a direction to raise the hook block. However, closing of the switch 92 energizes the coil 230 through conductors 132 and 234 causing the valve 222 to shift upward. When so shifted, the air line 224 is blocked and air line 216 is exhausted to atmosphere. As a consequence retraction of the rod 214 is precluded, when the coil 230 of the valve 222 is energized, while permitting pay off from the drum 52.

Closing of the switch 92 will energize both of the coils 130 and 230 shifting the associated valves 122 and 222. The rod 114 is, thereby, precluded from extending and the rod 224 precluded from retracting. The switch 92 is closed only when the output shaft 86 from the summation device 56 indicates that the hook block 54 has reached the predetermined distance from the boom 18. Because the solenoid valves 122 and 222 are located on only one of the two lines leading to each ram, the hook block 54 may be lowered and the boom raised by appropriate shifting of the valves 120 and 220.

While a preferred embodiment of the present invention has been disclosed herein, it will be appreciated that variations and modifications may be made without departing from the spirit of the invention as defined by the scope of the appended claims.

We claim:

1. In a crane having a boom pivotally mounted on the crane's upper works with a first wire rope wound on a boom hoist drum and connected to the boom, the boom being raised and lowered by respectively reeling in and paying out rope on said boom hoist drum, a hook block suspended from a second wire rope trained over a sheave rotatably carried on the boom and wound on a hook block drum, the hook block being moveable toward the boom by reeling in the second wire rope and by lowering the boom; an anti-two block system for preventing the hook block from approaching within a predetermined distance of said sheave, comprising:

a differential mechanism having a pair of side gears journaled on an output shaft and a spider gear meshing with said side gears and rotatable on a cross-shaft affixed to the output shaft;

boom drive means between said boom hoist drum and one of said side gears for determining the angular orientation of said boom;

hook block drive means between said hook block drum and the other of said side gears for determining the amount of said second rope payed off of said hook block drum;

a switch connected to and closeable by said output shaft in response to the output shaft being rotated as a result of said hook block reaching said predetermined distance;

first and second hydraulic pump and motor circuits for respectively driving said boom drum and said hook block drum;

a first and second pneumatic rams for respectively controlling the first and second circuits;

a first manual valve moveable to a boom lower position to direct air pressure to said first ram to drive said boom hoist drum to pay off said first rope;

a second manual valve moveable to a hook raise position to direct air pressure to said second ram to drive said hook block drum to reel in said second rope;

a first solenoid valve interposed between said first manual valve and said first ram permitting free communication therebetween when paying out and reeling in said first rope;

a second solenoid valve interposed between said second manual valve and said second ram permitting free communication therebetween when paying out and reeling in said second rope;

said solenoid valves being energized by the closing of said switch and thereby shifted to block communication of air pressure from said manual valves when moved to said positions.

* * * * *